United States Patent [19]

Beyer

[11] Patent Number: 4,921,507

[45] Date of Patent: May 1, 1990

[54] LAYOUT DEVICE

[76] Inventor: Bruce R. Beyer, 1572 Payne Ave., St. Paul, Minn. 55101-3058

[21] Appl. No.: 358,253

[22] Filed: May 3, 1989

[51] Int. Cl.[5] ..... B44D 3/38; B43L 7/00

[52] U.S. Cl. ..... 33/413; 33/414; 33/1 LE; 33/756

[58] Field of Search ..... 33/414, 413, 756, 768, 33/770, 1 LE, 1 G, 339

[56] References Cited

U.S. PATENT DOCUMENTS 3,122,836 3/1964 Aciego ..... 33/413
3,662,471 5/1972 Lynde ..... 33/770

FOREIGN PATENT DOCUMENTS 2370955 7/1978 France ..... 33/392

*Primary Examiner*—Harry N. Haroian
*Attorney, Agent, or Firm*—Herman H. Bains

[57] ABSTRACT

A layout tool includes a container having elongate generally rectangular-shaped front and rear walls, rectangular end walls, and a horizontal bottom wall. An opening extends through the central portion of the front adjacent its lower edge and extends into and upwardly through the bottom wall. The front wall has a linear scale on the exterior surface thereof. A chalk line has one end thereof extending through the opening in the front and bottom wall and is wound upon a reel of a chalk line mechanism. A weight is positioned in the container and stabilizes the latter against movement when the chalk line is stretched, pulled taut, and snapped against a surface to form an accurately located layout line on the surface.

5 Claims, 2 Drawing Sheets

LAYOUT DEVICE

FIELD OF THE INVENTION

This invention relates to a layout tool for use in snapping various types of chalk lines for layout purposes.

BACKGROUND OF THE INVENTION

In the construction industry, it is necessary to make accurate layout lines in locating structures, such as walls, to be erected. Typically, opposite ends of a chalk line device are held by two workers to locate the chalk line, and the chalk line is then snapped to mark the layout line on a surface. In some instances, a single worker ties one end of the chalk line to a nail driven into a floor at a selected location and holds the other end of the chalk line before snapping the layout line in place. In this procedure, the worker must first locate the proper position for the nail and must remove the nail after the line has been formed. Under present practices, either two workers are required to locate layout lines; or, in the instance of a single worker, nails must be driven and then removed, which results in a layout procedure that is slow and time-consuming.

There are certain prior art layouts which are used to snap various types of chalk lines, such as marking the location of walls and the like. For example, U.S. Pat. No. 1,271,470 discloses an early chalk line device for use in the layout of certain structures to be built. U.S. Pat. No. 4,202,108 discloses a layout tool for making vertical layout lines.

SUMMARY OF THE INVENTION

It is an object of this to provide a novel and improved layout tool, of simple inexpensive construction, which permits a single worker to accurately and quickly make layout lines at construction sites or the like.

A more specific object of this invention is to provide a novel layout tool, including a tool box having a weight therein for stabilizing the tool box, and having one end of the chalk line of a chalk line mechanism secured therein, whereby a single worker may readily and accurately snap various types of layout chalk lines.

In carrying out this invention, the layout tool includes a tool box having a handle and having a stabilizing weight positioned within the box. One end of the chalk line passes through an opening in the wall of the tool box and is secured to bottom wall of the tool box. One of the side walls of the tool box is provided with a scale along its lower edge and adjacent the chalk line opening. This external scale and the location of the chalk line relative to the scale permit accurate location of layout lines with respect to a reference line or point. A weight is positioned in the tool box and serves to stabilize the layout tool during the layout procedure. Slots and openings are formed in the side, end, and bottom walls of the tool box to permit the chalk line to be used to mark various types of vertical and horizontal layout lines, and to be used in dry line applications. In use, the weighted tool box permits a single person to readily locate and make various kinds of layout lines. In this regard, the layout tool is adapted for making construction layouts, wallpaper layouts, tile layouts, roofing layouts, inscribing circles, and other layout lines.

FIGURES OF THE DRAWING

DESCRIPTION OF THE PREFERRED EMBODIMENT

Figure 1:
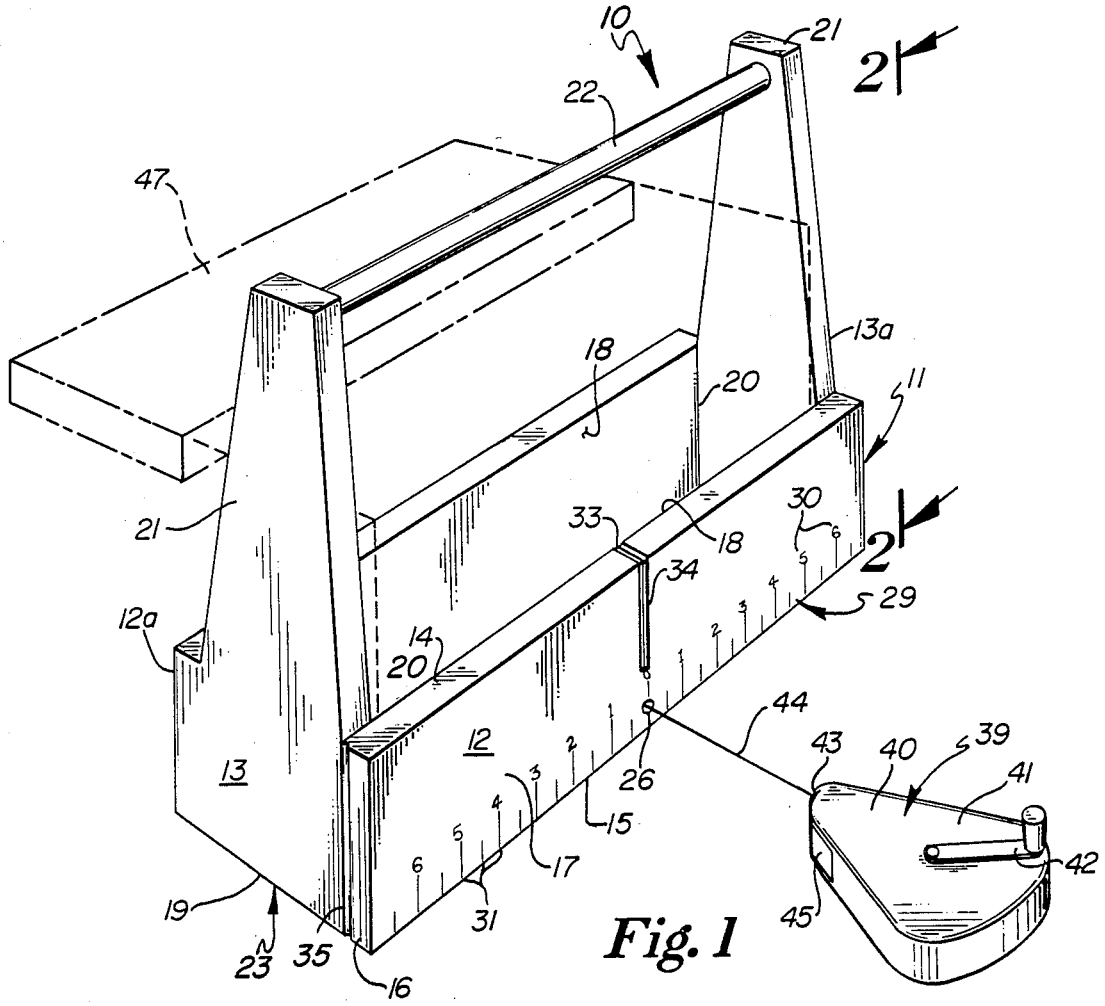
FIG. 1 is a perspective view of the novel layout tool.

Referring now to the drawings and, more specifically, to FIG. 1, it will be seen that one embodiment of the novel layout tool, designated generally by the reference numeral 10, is thereshown. The novel layout tool 10 includes a tool box 11, which may be formed of any suitable rigid material, such as wood, metal, plastic, or the like. The tool box 11 is of elongate, generally rectangular configuration and includes elongated generally rectangular-shaped side walls 12 and 12*a*, which are rigidly secured to opposed rectangular end walls 13 and 13*a*. The side walls 12 and 12*a* have upper edges 14, lower edges 15, end edges 16, an outer surface 17, and an inner surface 18. The side wall 12 is considered to be the face or front wall of the tool box.

The end walls 13 and 13*a* have lower edges 19, which are coplanar with the lower edges 15 of the side walls 14. The end walls 13 and 13*a* also have vertical edges 20, which abut the side walls, and each end wall is provided with an upwardly tapered extension 21. The upwardly tapered extension 21 of each end wall is rigidly interconnected by a cylindrical handle 22 to facilitate carrying the tool box.

Figure 4:
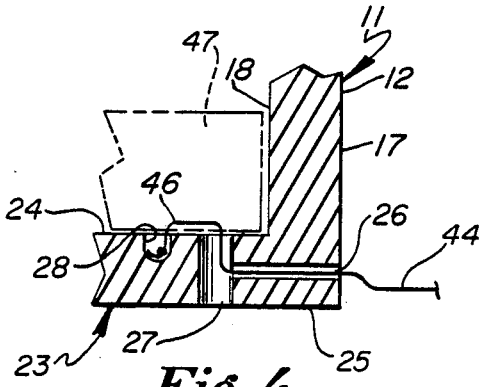
FIG. 4 is a cross-sectional view taken approximately along the line 4—4 of FIG. 3 and looking in the direction of the arrows.

The tool box 11 also include a generally rectangular-shaped bottom wall 23 having an upper surface 24 and a lower surface 25, which is co-planar with the lower edges of the side and end walls. The tool box 11 is provided with a horizontal opening 26 through the front side wall 12 and through one longitudinal edge of the bottom wall 23, as best seen in FIGS. 1 and 4. It will be noted that the horizontal opening 26 is located adjacent the lower edge 15 of the front side wall 12 at approximately the vertical mid-line of the front side wall. It will further be noted that the opening 26 is spaced intermediate the upper and lower surfaces of the bottom wall 23 and communicates with a vertical opening 27, which extends through the bottom wall 23.

The bottom wall 23 is also provided with a vertically extending, upwardly opening, retaining recess 28 therein, as best seen in FIG. 4. It will be noted that the recess 28 is positioned closely adjacent the vertical opening 27 through the bottom wall. It will further be noted that the front side wall 12 has a linear scale 29 thereon adjacent the lower edge 15 thereof throughout its length. The scale 29 is in inches and includes number indicia 30 and line indicia 31, which extend in opposite directions from a zero line and number designation 32. The horizontal opening 26 in the front side wall 12 is located at the number designation and zero line 32.

Figure 2:
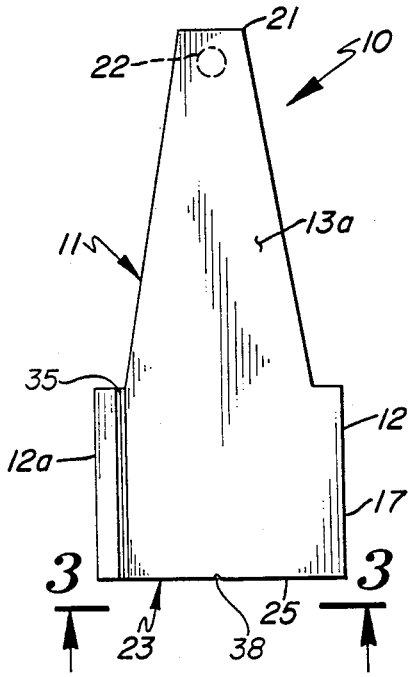
FIG. 2 is an elevational view thereof taken along line 2—2 of FIG. 1.

Referring now to FIG. 2, it will be noted that the front side wall 12 also has a vertical guide slot or groove 34 therein, which extends downwardly from the upper edge 14 thereof to the mid-portion of the side wall. The upper edge 14 of the front side wall 12 has line indicia 33 thereon at the mid-portion thereof which extends at a right angle to the vertical plane of the side wall and is coextensive with the vertical line 34. It will also be noted that the groove 34 is vertically aligned with the number and zero line indicia 32 and with the horizontal opening 26 at the side wall. Referring now to FIG. 1, it will be noted that each end of the tool box 11 has a vertical guide slot or groove 35 therein. Each vertical groove 35 is located at the juncture between the front side wall 12 and one of the vertical edges of an end wall 13 or 13*a*.

Figure 3:
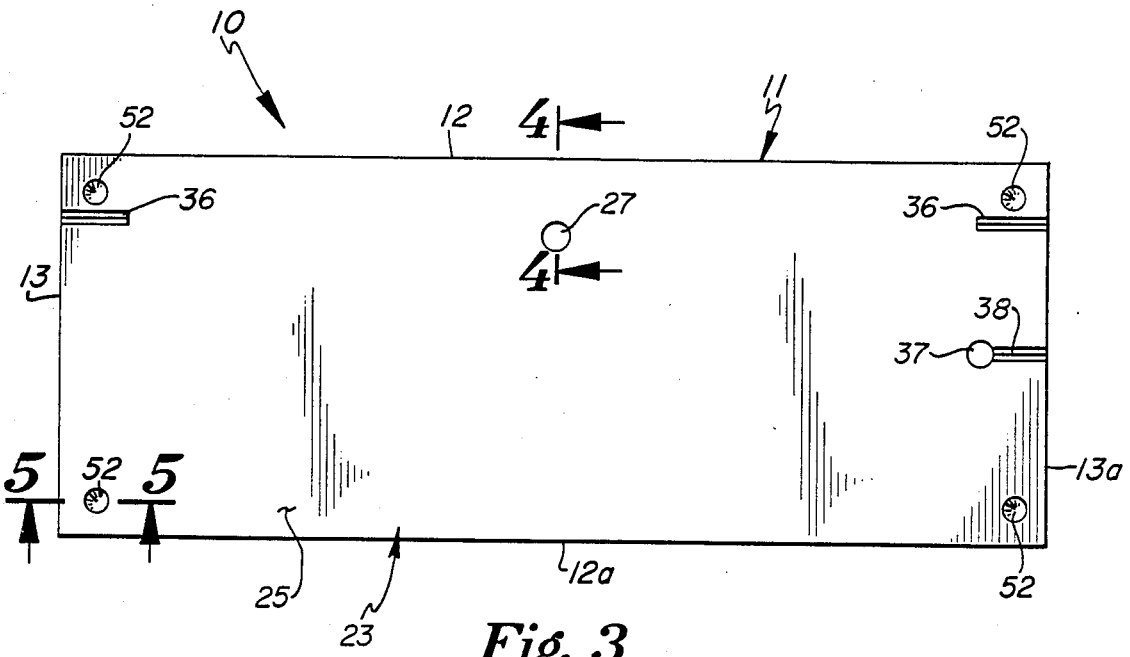
FIG. 3 is a bottom plan view thereof taken along line 3—3 of FIG. 2.

Referring again to FIG. 3, it will be seen that the lower surface of the bottom wall 23 has a pair of longitudinally extending guide slots 36 therein, each communicating with one of the vertical slots 35. Thus, it will be noted that the slots 36, while extending only a short distance longitudinally of the bottom wall from adjacent the associated vertical slot 35, are nevertheless disposed in longitudinal alignment with each other. The vertical slots 35 also lie in the same vertical plane.

Referring again to FIG. 3, it will be seen that an opening 37 is drilled through the bottom wall 23 adjacent the end wall 13 at a point located equidistant from the longitudinal edges of the bottom wall. The opening 37 communicates with a longitudinally extending guide slot 38 in the bottom wall, which extends from the opening 37 to the end wall 13.

The layout tool 10 is intended for use with a chalk line for quickly and accurately marking various kinds of layout lines. Any of the commercial chalk line devices, such as the commercial chalk line device 39, may be used. The chalk line device 39 is merely illustrative of conventional chalk line devices and comprised of a housing 40 having a reel 41 journaled therein and provided with a reel handle 42, which is located exteriorly of the housing. The housing 40 is provided with an opening 43 therein through which an elongate string or cord 44 extends. The string 44 has one end thereof wound upon the reel and extends outwardly through the opening 43 in the housing. A chalking powder 45 is positioned within the housing adjacent the opening 43 so that the string is moved through and coated by the chalking powder 45 as it is wound and unwound from the reel 41. Regardless of the chalk line device used, it will be seen in FIG. 4 that the outer end portion 46 of the string 44 extends through the opening 26 and upwardly through the opening 27 in the bottom wall 23. The end portion 46 of the string has a knot tied therein, and the knot is pressed into the upwardly opening retaining recess 28 in the bottom wall 23.

Means are also provided for stabilizing the tool box 11 during use of the layout tool, and this means includes a generally elongate rectangular-shaped weight 47, preferably formed of metal, such as steel or the like, and positioned within the tool box upon the bottom wall 23. In the embodiment shown, the rectangular-shaped weight 47 has length and width dimensions only slightly less than the interior length and width dimensions of the tool box 11. There is approximately one-eighth inch clearance between the end edges of the weight 47 and the adjacent end walls of the tool box, and approximately one-eighth inch clearance between the longitudinal edges of the weight and the adjacent side walls of the tool box. It will be noted that the weight 47 also is positioned upon and retains the end portion 46 of the string 44 in clamped relation within the tool box.

When the layout tool 10 is to be used to locate an outside wall or an inside wall of a building, the user will position the layout tool so that one of the numbers on the scale 29 is aligned with a reference line. The tool box 10 will be positioned so that the front side wall 12 faces the direction of the chalk line to be snapped. For example, in locating an outside wall, the tool box may be positioned so that the scale is disposed on the reference line at the 5½ inch indicia.

Typically, the scale may be positioned on the reference line at the 3½ inch designation in locating an inside wall. After the tool box has been positioned on the reference point or line, the worker will then unreel the string from the chalk line mechanism 39 until the correct distance is reached. The point is then located by the user adjacent the end of the chalk line and the string is placed upon the point, and the chalk line is snapped to produce the layout line. The user then turns the tool box 11 90 degrees from its original position so that the front side wall 12 is again facing the direction of the chalk line to be snapped. The user then places the tool box so that the scale is on the proper indicia with respect to the reference line and the chalk line marking continues. It will be appreciated that, using this system, a single layout worker can rapidly and accurately lay out the location of walls and similar structures at construction sites. The stabilizing weight assures the worker that the positioning of the end of the chalk line will be retained in the selected location. The provision of an external scale 29 on the front side wall 12 of the tool box 11 allows the user to measure in either direction from a reference point. It will be appreciated that a single worker may quickly and accurately lay out chalk lines without having to locate and drive in nails (and thereafter remove the nails).

The layout tool may also be used to mark a vertical layout line by extending the layout string or cord 44 diagonally along the lower surface of the bottom wall 23 until the string engages in one of the slots 36. The string may then be pulled upwardly through the vertical slot 35 until the correct vertical distance is reached and the point located. The user will then snap the line on an existing vertical surface to locate a layout line. A vertical line may also be located by moving the line upwardly through the slot 34 in the side wall. With this arrangement, a single user can provide layout lines for the layout on vertical walls and on arches in walls. Again, it will be noted that the single user is not required to drive nails in making vertical layout lines, as required in the conventional practice.

In scribing layout circles, the user will place the zero indicia at the center of the circle to be scribed and along the line passing through the center. The string 44 will then be unwound until the correct radius is reached.

After determining the correct radius, the user may then scribe a semi-circle, using a pencil or other marking device, and using the selected radius. The tool box may then be repositioned on the same point and on the same semi-circular diameter, but with the box facing in the opposite direction (rotating the tool box through an arc of 180 degrees from its original position). The selected radius will then again be marked, forming the matching semi-circle.

The layout tool is also used in dry line work where actual measurements are made along the cord or string 44, rather than using the string to make a layout chalk line. When used in dry line work, the string 44 has its knotted end 46 inserted into the retaining recess 28 and is then passed downwardly through the opening 37 in the bottom wall 23 and is seated in the slot 38. In dry line work, the string 44 is pulled taut and the force exerted on the tool box 11 is greater than the force normally exerted when snapping chalk lines. It is for this reason that the string 44 is pulled through the opening 37 and outwardly away from and normal to the end wall 13.

It will be appreciated that the center of mass of the weight 47 will be located further away from the pulling force when doing dry line work, as compared to the pulling force exerted on the tool box (and its center of mass) when doing chalk line layouts. The pulling force exerted on the tool box, when doing chalk line layout work, is substantially closer to the center of mass of the weight; but, since a lighter pulling force is required in this chalk line marking operation, there is little if any tendency to move the tool box from its properly located position. Since the center of mass is located further from the application of force in dry line work, a greater pulling force may be exerted on the tool box via the string 44 without causing the tool box to be moved from its properly located position.

Figure 5:
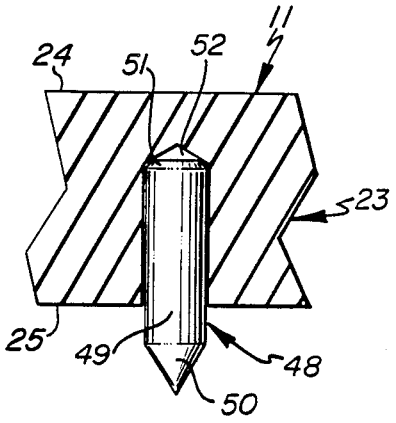
FIG. 5 is a cross-sectional view taken approximately along the line 5—5 of FIG. 3 and looking in the direction of the arrows.

Referring again to FIG. 5, it will be seen that the tool box 11 is provided with anchoring feet 48, each being located adjacent one of the corners of the bottom wall 23. The anchoring feet 48 are of cylindrical configuration and each includes a depending pointed end 49 of generally conical configuration. Each anchoring foot 48 also has an upper chamfered end 51. Each anchoring foot 48 is insertable into a downwardly facing socket 52 in the bottom wall 23 adjacent one corner of the latter. When the anchoring feet 48 are urged into the associated sockets, each anchoring foot will engage the socket with a friction fit.

When applied to the lower wall 23 of the tool box 11, the pointed lower end of each anchoring foot may be inserted into a surface, including asphalt, concrete, wood, or the like, to stabilize the tool box against movement when a substantial pulling force is exerted by the string 44 during dry line work. A user may grip the anchoring foot with a plier and forcibly remove the same after the dry line work has been completed.

What is claimed is:

1. A layout tool for snapping various types of layout chalk lines on a work area surface, such as construction sites or the like, comprising:

a container having elongate generally rectangular front and rear walls, opposed end walls, and a horizontal bottom wall, means extending between and connected with opposed walls of said container and defining a handle, said front wall having an opening in the mid-portion thereof adjacent said bottom wall, said opening extending into and upwardly through said bottom wall, said front wall having a linear scale on the exterior surface thereof extending throughout the length of said front wall adjacent the lower edge thereof, said scale having a zero point at said opening and having line and number indicia extending in opposite directions therefrom, an elongate flexible chalk line having one end thereof extending therefrom through the opening in the front and bottom walls, a weight member positioned interiorly of said housing upon said bottom wall, said weight member having length and width dimensions corresponding to and only slightly less than the length and width dimensions of the interior of said container, said weight member clamping said one end of the chalk line string within the container, and stabilizing the container against movement from a preset position relative to said scale to permit said chalk line string to be pulled tight and snapped to form a layout chalk line on the surface of a work area.

2. The layout tool as defined in claim 1 and a second opening extending vertically through said bottom adjacent one end wall thereof, an elongate guide slot in the lower surface of said bottom wall and extending longitudinally from said second opening through the lower edge of the adjacent end wall, said one end of said string extending through said second opening and through said guide slot in the bottom wall to permit said string to be pulled and stretched in a direction normal to the adjacent end wall when the tool is used to do dry line work.

3. The layout tool as defined in claim 1 and vertical guide slots in said end walls extending upwardly from the respective lower edge thereof, and permitting the chalk line string to be stretched and snapped against a vertical surface to form a vertical layout line when the container is positioned on a horizontal surface and with the end wall positioned closely adjacent the vertical wall to be marked.

4. The layout tool as defined in claim 2 and a plurality of downwardly pointed pin elements extending into sockets in said bottom wall of the housing and projecting downwardly therefrom, each pin located adjacent one of the corners of said bottom wall and penetrating a surface upon which the housing is positioned to stabilize the same when the layout tool is used to do dry line work.

5. The layout tool as defined in claim 3 and a vertical guide slot in said front side wall located at the vertical mid-line plane and permitting a chalk line to be seated in said last mentioned guide slot and stretched and thereafter snapped against a vertical surface.

* * * * *